US012808543B2

(12) United States Patent
Hale et al.

(10) Patent No.: US 12,808,543 B2
(45) Date of Patent: Nov. 24, 2026

(54) FIRE PIT WITH REMOVABLE ASH CATCH

(71) Applicant: Quality Craft Industries Inc., Romeoville, IL (US)

(72) Inventors: Dennis Hale, Willowbrook, IL (US); Marcus W. Bosch, Belding, MI (US); Shelley Nehrt, Barrington, IL (US)

(73) Assignee: Quality Craft Industries Inc., Romeoville, IL (US)

( * ) Notice: Subject to any disclaimer, the term of this patent is extended or adjusted under 35 U.S.C. 154(b) by 513 days.

(21) Appl. No.: 18/107,483

(22) Filed: Feb. 8, 2023

(65) Prior Publication Data

US 2023/0184439 A1 Jun. 15, 2023

Related U.S. Application Data

(63) Continuation of application No. 17/541,087, filed on Dec. 2, 2021, now Pat. No. 12,345,419.

(Continued)

(51) Int. Cl.
*F24B 1/195* (2006.01)
*F24B 1/181* (2006.01)

(Continued)

(52) U.S. Cl.
CPC ..... *F24B 1/195* (2013.01); *F24B 1/181* (2013.01); *F24B 1/182* (2013.01); *F24B 1/1915* (2013.01)

(58) Field of Classification Search
None
See application file for complete search history.

(56) References Cited

U.S. PATENT DOCUMENTS 2,161,669 A 6/1939 Freeman
4,457,290 A * 7/1984 Edwards ..... A47J 37/0704 126/25 R (Continued)

FOREIGN PATENT DOCUMENTS

CN 108826360 A 11/2018
GB 2340930 A * 3/2000 ..... F24B 1/202

(Continued)

OTHER PUBLICATIONS

International Search Report and Written Opinion received for PCT Patent Application No. PCT/US2021/061882, mailed on Feb. 25, 2022, 12 pages.

(Continued)

*Primary Examiner* — Jason Lau
(74) *Attorney, Agent, or Firm* — Shook, Hardy & Bacon L.L.P.

(57) ABSTRACT

A fire pit includes a wall panel that cooperates to define a lateral boundary of a burn chamber. The sidewall also defines an upwardly facing opening into the burn chamber. An ash catch is removably received in the fire pit through the upwardly facing opening and may be moved downwardly through the burn chamber to a resting location where the ash catch defines a lower boundary of the burn chamber. The wall panel has an exterior wall segment spaced apart from an interior wall segment to define a passageway there between. The wall panel has a lower opening through which air may flow up into the passageway. The interior wall segment includes a plurality of openings therein through with air may flow out of the passageway into the burn chamber to help fuel a fire in the burn chamber.

3 Claims, 14 Drawing Sheets

Related U.S. Application Data

(60) Provisional application No. 63/210,477, filed on Jun. 14, 2021, provisional application No. 63/121,772, filed on Dec. 4, 2020.

(51) Int. Cl.
*F24B 1/182* (2006.01)
*F24B 1/191* (2006.01)

(56) References Cited

U.S. PATENT DOCUMENTS

| | | | |
|---|---|---|---|
| 4,869,228 | A | 9/1989 | Sorensen |
| 2006/0225725 | A1 | 10/2006 | Rinaldo |
| 2008/0053427 | A1 | 3/2008 | McGinness |
| 2010/0288261 | A1 | 11/2010 | Jones |
| 2012/0255542 | A1 | 10/2012 | Kukuliyev |
| 2014/0238378 | A1 | 8/2014 | Scott |
| 2020/0224879 | A1 | 7/2020 | Scott |
| 2020/0309369 | A1 | 10/2020 | Jan et al. |
| 2021/0285648 | A1 | 9/2021 | Kim et al. |

FOREIGN PATENT DOCUMENTS

| | | | | |
|---|---|---|---|---|
| KR | 10-1186499 | B1 | | 9/2012 |
| KR | 20200077403 | A | * | 6/2020 |
| KR | 2020-0078427 | A | | 7/2020 |

OTHER PUBLICATIONS

Non-Final Office Action received for U.S. Appl. No. 17/541,087, mailed on Apr. 10, 2024, 21 pages.
International Preliminary Report on Patentability received for PCT Application No. PCT/US2021/061882, mailed on Jun. 15, 2023, 11 pages.
Notice of Allowance received for U.S. Appl. No. 17/541,087, mailed on Mar. 18, 2025, 5 pages.
Final Office Action received for U.S. Appl. No. 17/541,087, mailed on Nov. 27, 2024, 14 pages.
Non-Final Office Action received for U.S. Appl. No. 18/435,862, mailed on Apr. 18, 2025, 10 pages.
Office Action received for Canadian Patent Application No. 3231965, mailed on Dec. 30, 2025, 5 pages.
Notice of Allowance received for U.S. Appl. No. 18/435,862, mailed on Dec. 18, 2025, 5 pages.

* cited by examiner

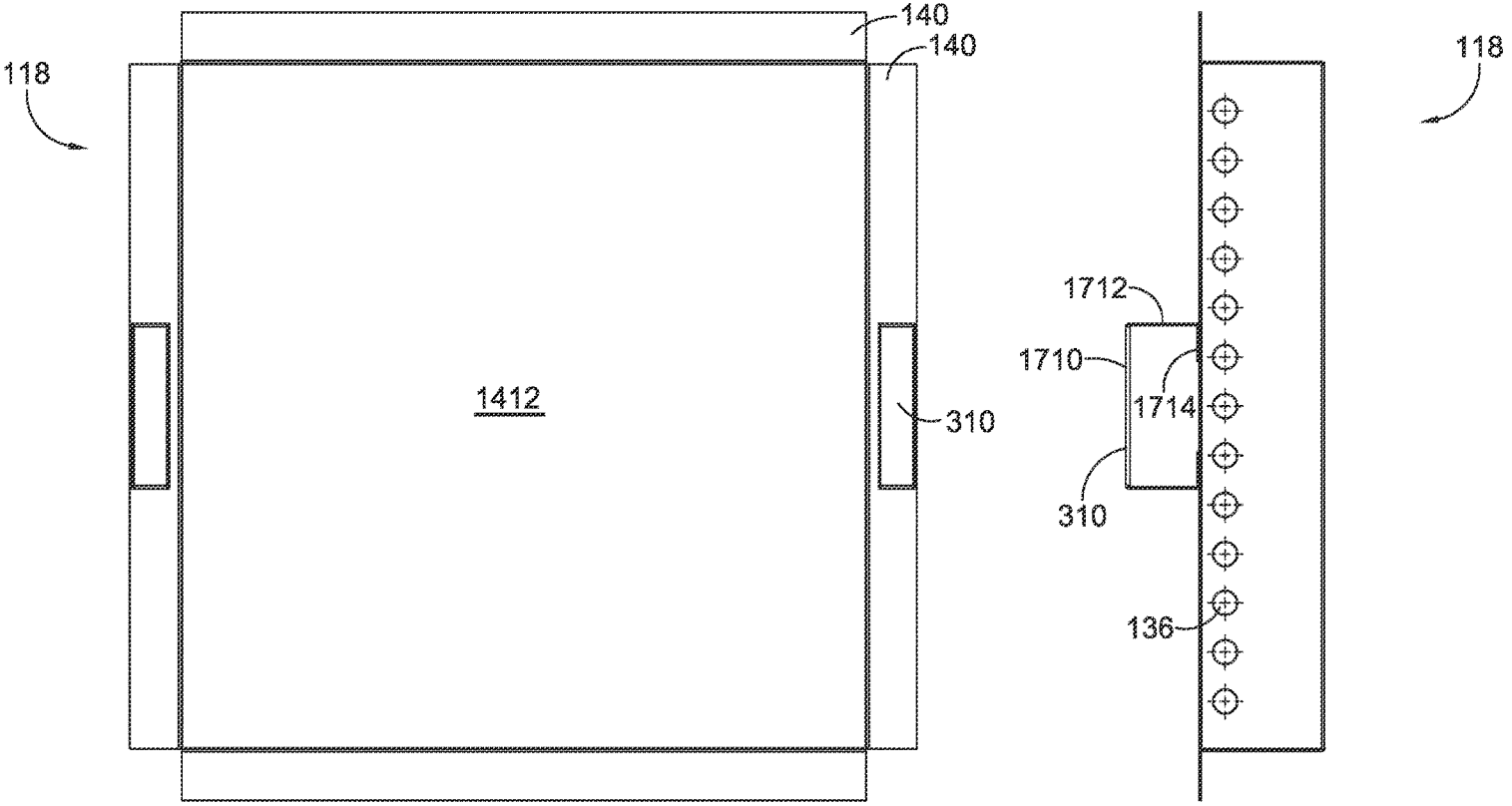
FIG. 17
FIG. 16
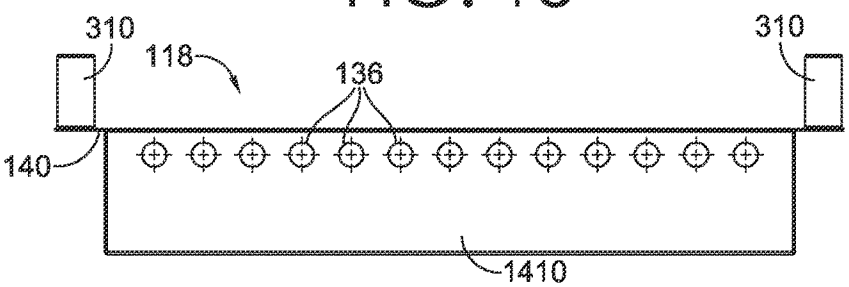
FIG. 15

FIRE PIT WITH REMOVABLE ASH CATCH

CROSS-REFERENCE TO RELATED APPLICATIONS

This application is a continuation of U.S. patent application Ser. No. 17/541,087, entitled "Assemblable Fire Pit", filed Dec. 2, 2021, which claims the benefit of U.S. Provisional Patent Application No. 63/121,772, entitled "Assemblable Smoke-Free Fire Pit", filed Dec. 4, 2020, and U.S. Provisional Patent Application No. 63/210,477, entitled "Assemblable Smoke-Free Fire Pit", filed Jun. 14, 2021. The entire contents of each of these referenced applications are incorporated herein by reference.

BACKGROUND

In recent years, "smoke free" or "smokeless" fire pits have become popular. Common fire pits of this type have a double wall construction with holes near the top and bottom of the interior wall. This allows air to be drawn up between the walls via convection and discharged in the interior of the burn chamber. Outside air is pulled into the bottom holes and moves through the hollow wall up to the inside holes. As the air moves up, it is heated. The heated air is released through the inner holes into the top of the burn chamber, infusing the fire with an extra boost of oxygen, which improves the burn.

However, there are some drawbacks with the existing fire pits. First, they are sold to consumers as a complete unit due at least in part to the dual-wall construction. The available units are typically round and generally constructed from flat sheets of metal bent in certain shapes and then welded together to form the dual wall fire pit. This requires the units to be sold as a fully assembled fire pit. As a result, when each unit is boxed for transportation and sale, the box contains a large amount of empty space, generally in the burn chamber area. What is needed is a design of a fire pit that can be assembled by an end user from various panels or parts that can be stacked flat for packaging and shipping to reduce the amount of space required in the container when compared to current versions, yet still offer the benefits of a double wall construction.

SUMMARY

Embodiments of the present disclosure relate to a fire pit configured to be sold in a disassembled state and be assembled by the end user or other person. In the disassembled state, the various components (as discussed herein) are in a relatively flat configuration. In the disassembled state, the components contain relatively less void space between the components, in comparison to the assembled state. In the disassembled state, the components may be packaged into a relatively small container, compared to the size of a container that would be required to hold a fire pit that is similar in size to the present fire pit when fully assembled. Embodiments of the invention thus allow for the packaging of a fire pit using less packaging than traditional fire pits and/or allow for an ultimately larger operational fire pit to be packaged in a similar amount of packaging.

A first example embodiment of the invention is directed to a fire pit. The fire pit includes a plurality of wall panels, an ash catch, and a grate. The plurality of wall panels are configured to define a burn chamber when connected together. Each of the plurality of wall panels has an interior wall segment spaced apart from an exterior wall segment. The ash catch is removably positionable and configured to be disposed within the burn chamber. The grate is positionable above the ash catch. A first wall panel of the plurality of wall panels is configured to be secured to a second wall panel of the plurality of wall panels.

A second example embodiment of the invention is directed to a fire pit system configured to be assembled by an end user. The system includes a plurality of wall panels, an ash catch, and a grate. The plurality of wall panels are configured to be secured together by the end user to form a burn chamber. Each of the plurality of wall panels has an interior wall segment spaced apart from an exterior wall segment. Each interior wall segment includes at least one opening in an upper end to allow airflow into the burn chamber. The ash catch is removably positionable and configured to be disposed within the burn chamber by the end user. The grate is positionable above the ash catch by the end user.

A third example embodiment of the invention is directed to a method of assembling a fire pit. The method may include securing a plurality of wall panels together to form a burn chamber, with each of the plurality of wall panels having an interior wall segment spaced apart from an exterior wall segment. The method may further include positioning an ash catch on a flange of one or more of the interior wall segments within the burn chamber. The method may further include removably positioning a grate above the ash catch.

Other embodiments of the invention may be directed to a fire pit comprising the plurality of wall panels. Still other embodiments of the invention may be directed to manufacturing a fire pit as described herein. Yet still other embodiments of the invention may be directed to using the fire pit described herein to burn a fuel. These and other embodiments may be within the scope of the invention.

BRIEF DESCRIPTION OF THE DRAWINGS

The present systems and methods for fire pits are described in detail below with reference to the attached drawing figures, wherein:

FIG. 15 is a top plan view of the ash catch of FIG. 14;

FIG. 16 is a front elevation view of the ash catch of FIG. 14;

FIG. 17 is a side elevation view of the ash catch of FIG. 14;

DETAILED DESCRIPTION

Systems and methods are disclosed related to fire pits. Although primarily described herein with respect to fire pits, this is not intended to be limiting, and the systems and methods of the present disclosure may be implemented in any implementation. For non-limiting examples, the systems and methods described herein may be implemented for various types of fire pits, fire places, grills, smokers, kilns, forges, and other devices and systems that contain a fire. In other non-limiting examples, the systems and methods described herein may be implemented for various types of fuel/heat sources, such as wood (including logs, chunks, chips, etc.), charcoal, pellets, propane, butane, electric, or the like.

Figure 6:
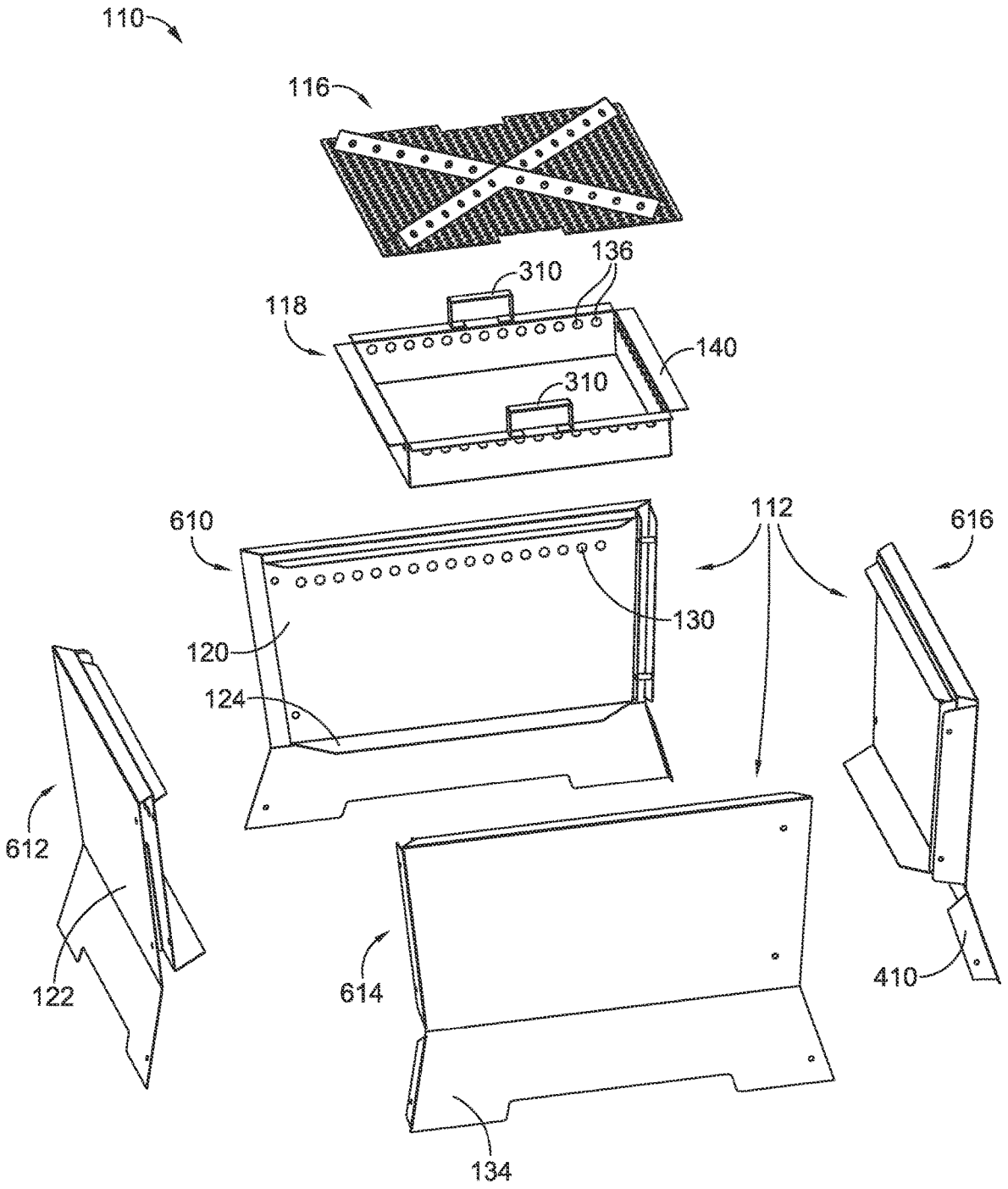
FIG. 6 is an exploded view of the fire pit of FIG. 1.

Referring now to the accompanying drawings, a fully assembled fire pit 110 made in accordance with the present disclosure is shown. A fully assembled version of the fire pit 110 of the present disclosure is displayed in two perspective views in FIGS. 1 and 2. Embodiments of the invention are configured to be sold in a disassembled state, such as shown in FIG. 6, and be assembled by the end user or another person. In the disassembled state, the various components (as discussed herein) are in a relatively flat configuration. In the disassembled state, the components contain relatively less void space between the components, in comparison to in the assembled state. In the disassembled state, the components may be packed into a relatively small packaging, compared to an amount of packaging that would be required to package the fire pit 110 in its fully assembled state. Embodiments of the invention thus allow the packaging of a fire pit 110 using less packaging than that of traditional fire pits 110 and/or allow for a larger fire pit 110 to be packaged in a similar amount of packaging. This not only reduces international and domestic shipping costs, but also reduces the amount of display space needed in a store.

In embodiments of the invention, an end user may acquire a packaged fire pit 110 in a disassembled state. The end user may then assemble the fire pit 110 upon removing the components from the packaging. The assembled fire pit 110 may be substantially larger than the packaging. The components may be assembled via various methods as described herein. The assembled fire pit 110 may thus be assembled and disassembled as needed by the end user.

The fire pit 110 is assembled from a plurality of wall panels 112 (such as four, as shown in the drawings). The wall panels 112, once assembled, define a burn chamber 114 there between. Any of various fuels and/or heat sources may be placed within the burn chamber 114 on top of a grate 116 to be burned. The grate 116 sits on top of a removable fire pan or ash catch 118. Ash and other debris from the burning fuel may then fall through the grate 116 and into the ash catch 118 during operation. The ash may then remain in the ash catch 118 until the ash catch 118 is removed by an end user for disposal. The ash catch 118 also allows for the ash to be selectively removed from the burn chamber 114 so as to not hamper the burning process. This allows for a more clean burn in the burn chamber 114. While the illustrated embodiment and the description below describe one possible embodiment of an ash catch, the term "ash catch", as used herein, should not be narrowly construed to cover the illustrated embodiment but should be broadly defined as an item of any size, shape, and construction that performs the function of collecting or holding ashes that result from the burning of fuel or heat sources there above and can be removable from, separate from, or affixed to the fire pit.

Figure 1:
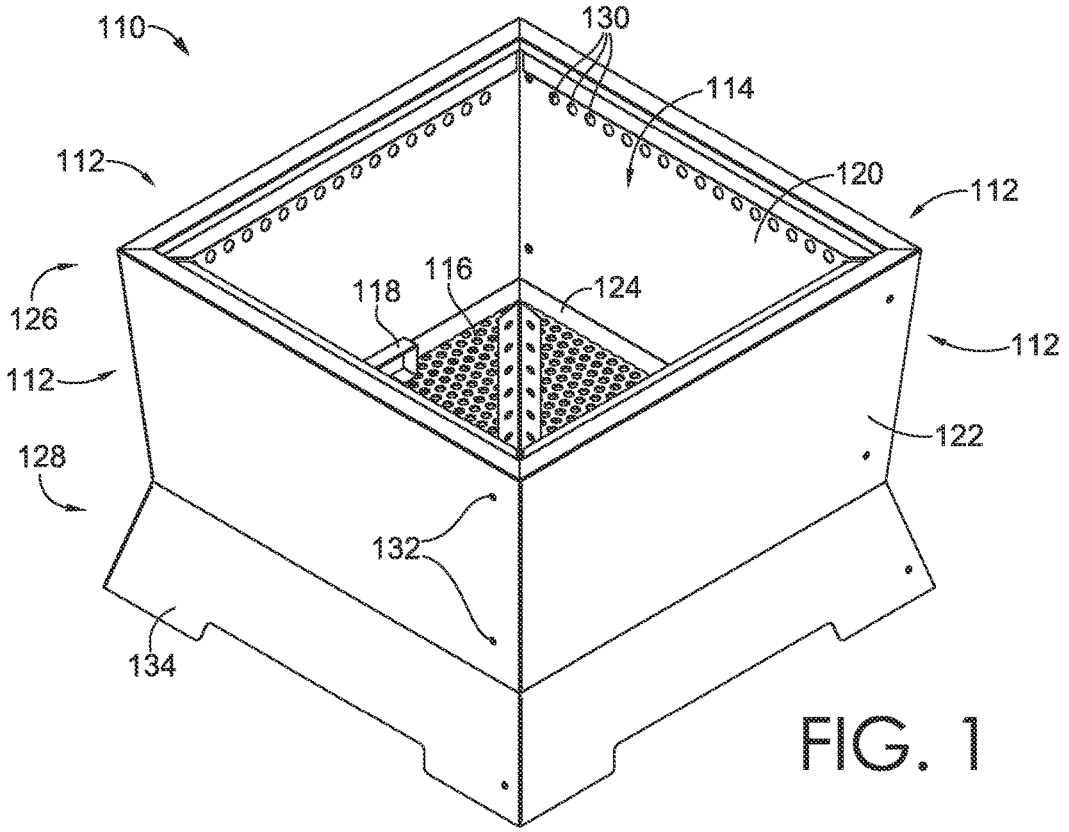
FIG. 1 is a top perspective view of a fire pit from a first angle, in accordance with some embodiments of the present disclosure.
Figure 2:
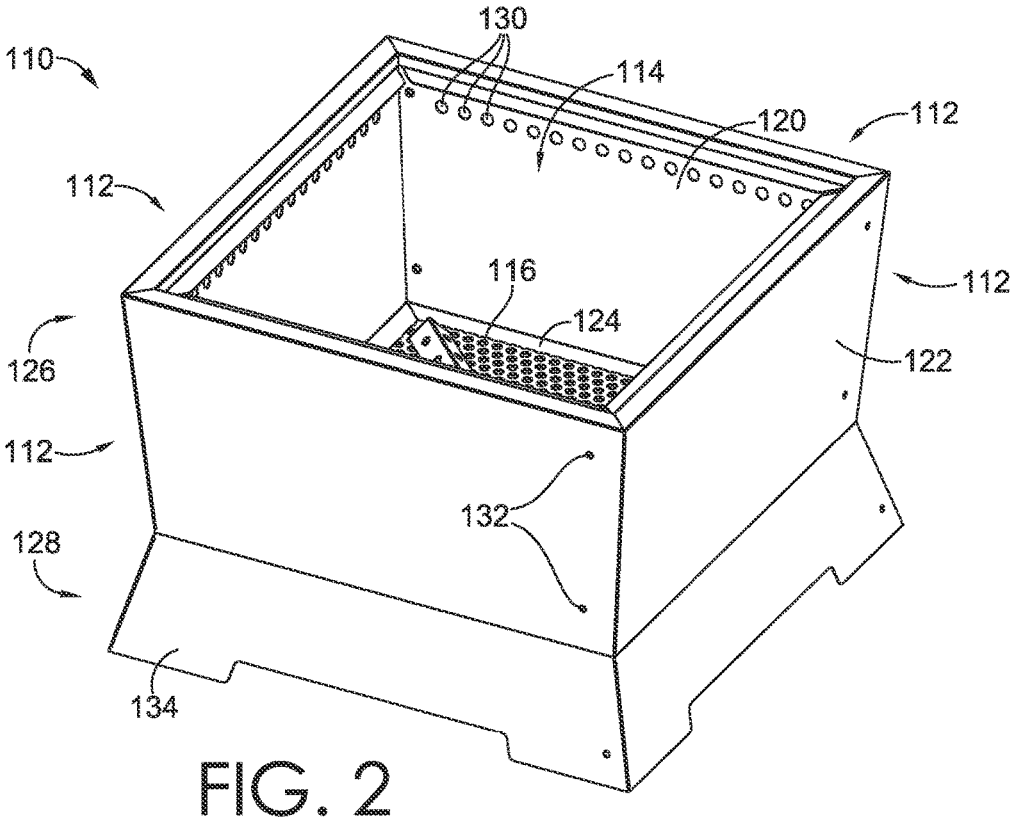
FIG. 2 is a top perspective view of the fire pit of FIG. 1 from a second angle.
Figure 20:
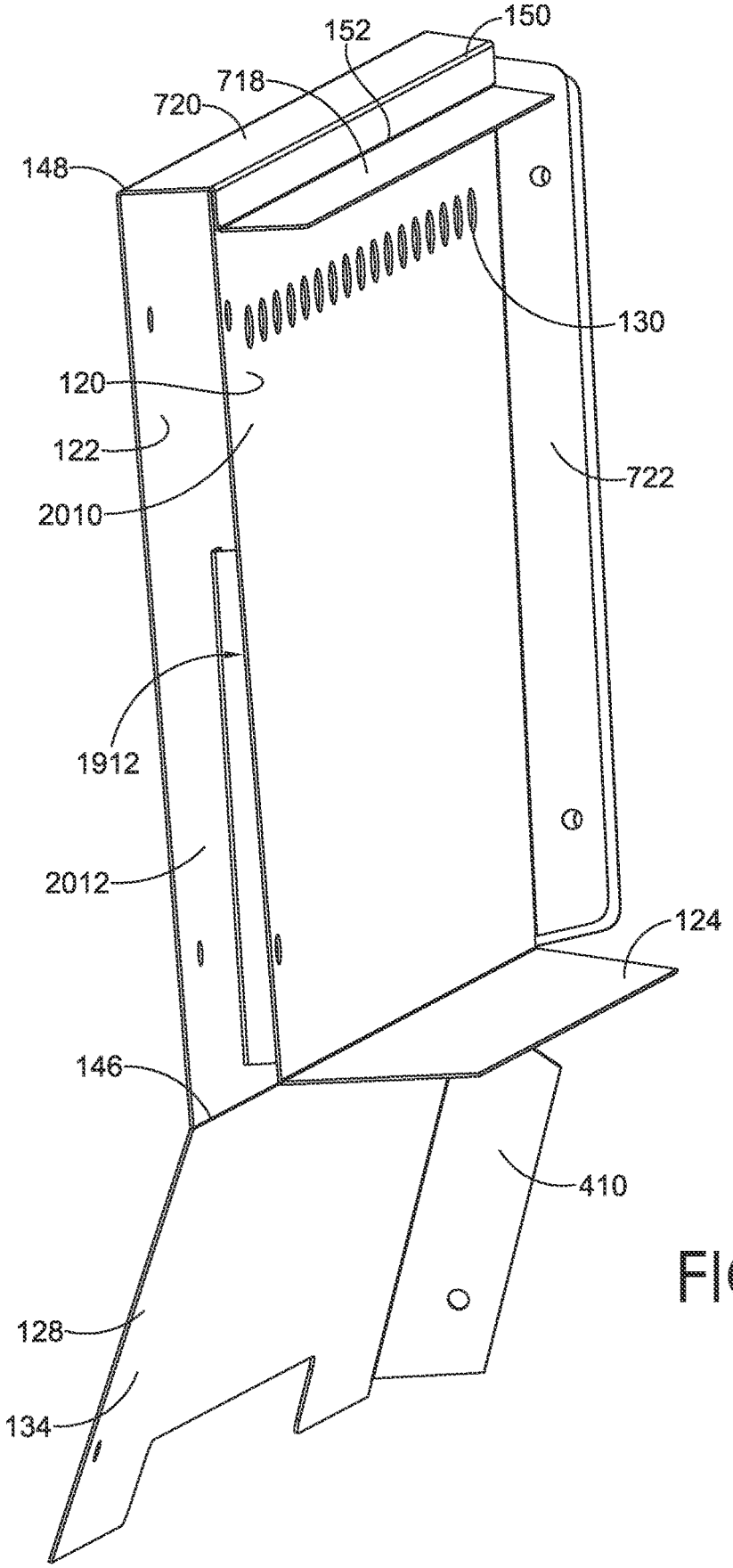
FIG. 20 is a top left perspective view of the side wall of FIG. 7 from a sixth angle illustrating interior components thereof.

In embodiments, each wall panel 112 includes an interior wall segment 120 and an exterior wall segment 122, as illustrated in FIGS. 1, 2, and 20. The interior wall segment 120 of the wall panel 112 may include a lower support or flange 124 extending into the burn chamber 114 to support at least one of the grate 116 and the ash catch 118. As used herein, the term "flange" is used broadly as a generic reference to a piece of material that extends from a portion of another piece of material and does not require the provision of additional strength or stiffness. Further, it does not imply any particular dimensions. It can be elongate in a lateral direction, short in a lateral direction (e.g., like a tab), or anywhere in between. The wall panel 112 has an upper end 126 and a lower end 128. The upper end 126 may include one or more airflow openings 130 into the burn chamber. Primarily due to convection, air is drawn up into the wall panel 112 at the lower end 128, which is open toward the ground. The air, as it is heated, rises up through and interior of the wall panel 112 between the inner wall 120 and the outer wall 122, and out into the burn chamber 114 through the airflow openings 130 at the upper end 126. Securing openings 132 may be configured to allow for securing of one wall panel 112 to an adjacent wall panel 112, as discussed herein. The lower end 128 may also include a base 134 configured to rest upon an underlying surface and provide stability while keeping the burn chamber 114 away from the underlying surface.

The wall panels 112 may include interlocking flanges on one side with holes therein that align with holes in an adjacent panel (see FIGS. 10-13). The holes in the flanges can be spaced apart by a tube positioned between the flanges and coaxial with the aligned holes in the adjacent flanges so the holes and the tube form a passageway for the user to place a bolt in during assembly. The tubes direct the bolt from one hole to the next so the distal end of the bolt does not get "lost" inside the wall panel 112 during assembly. The user aligns both sets of holes and places a bolt there through to couple adjacent panels. The metal sheet material can be laser cut while flat before the bending occurs. The holes for the bolts and the airflow openings 130 for the air flow can be cut out at the same time. The metal sheet material may be bent back upon itself to form the dual wall construction. A first portion of the exterior wall segment 122 of the wall panel 112 may be bent outwardly to form the base 134 when fully assembled. A first portion of the interior wall segment 120 may be bent inwardly to form the ledge 124 upon which the fire pan or ash catch 118 may be supported in use.

In some embodiments, the wall panels 112 may be identical, for ease of manufacture and assembly. In other embodiments, the wall panels 112 can vary from one to another for a particular design. The wall panels 112 may be formed from metal sheet material bent to provide a dual-wall structure.

With reference to FIG. 1, the two rearward wall panels 112 illustrate the interior wall segments 120 with the plurality of airflow openings 130 at the upper end 126 thereof to assist with the double burn found in smoke-free or reduced-smoke fire pits with a double wall construction. The two forward wall panels 112 illustrate a first portion of the exterior wall segments 122 of the wall panels 112 that are bent outwardly to form the base 134 at the lower end 128 thereof.

Figure 3:
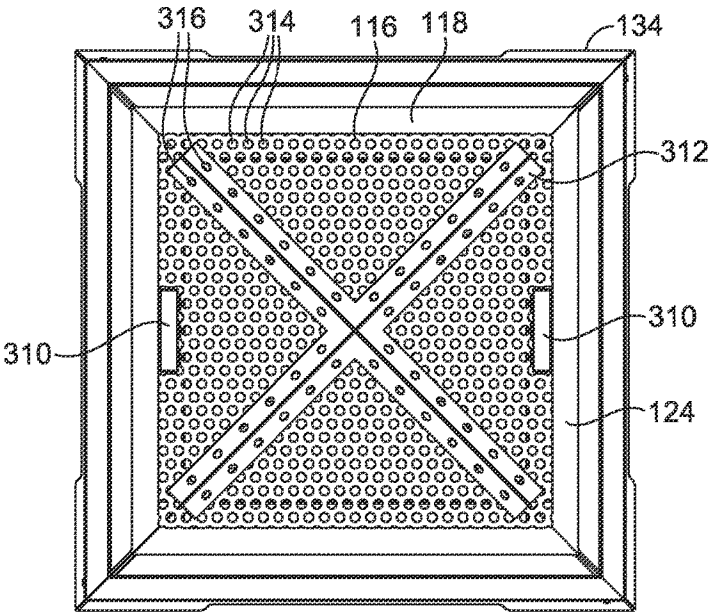
FIG. 3 is a top plan view of the fire pit of FIG. 1.

The grate 116 will now be discussed in more detail. FIG. 3 is a top plan view of the fire pit 110 of FIG. 1, which more clearly illustrates the grate 116. The grate 116 is configured to sit atop the ash catch 118 such that at least one handle 310 of the ash catch is accessible through or beside the grate 116. The grate 116 may have a cross member 312 for structural stability. The grate 116 may be a metal plate with a plurality of openings 314 there through to provide for the passage of air during the burning of the material placed inside the burn chamber 114, as well as the passage of ash into the ash catch 118. The grate 116 may be reinforced with the cross member 312 which, in the illustrated embodiment is in the shape of an angle iron. The arms of the cross member may have holes 316 there through to further facilitate the passage of air from below the grate 116 up through the grate 116 and into the burn chamber 114 during use. Also visible in FIG. 3 are two handles 310 that may be used to lift the fire pan or ash catch 118 directly up out of the top of the burn chamber 114 to dump or dispose of the ashes contained therein. The grate 116 sits between and partially around the two handles 310 such that the handles 310 protrude up through the grate 116 to be accessed by a user.

Figure 4:
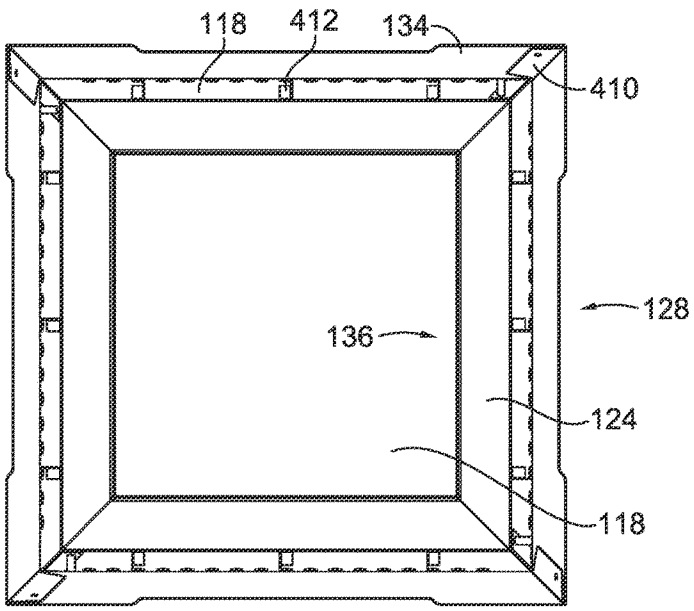
FIG. 4 is a bottom plan view of the fire pit of FIG. 1.

FIG. 4 is a bottom plan view of the fire pit 110 of FIG. 3 illustrating a bottom of the ash catch 118, which is obstructing the view of the grate 116 there above. FIG. 4 shows a securing overlap or tab 410 extending from one wall panel 112 to another. As used herein, the term "tab" is used broadly a generic reference to a piece of material extending from another piece of material. A fastener is secured between the securing tab so as to secure the one wall panel 112 to the other. A lower ledge that is formed by the flange 124 on each of the interior wall segments 120 of each wall panel 112 is shown. Visible in the space between the inner wall 120 and exterior wall 122 are a plurality of gussets 1912 (also visible in FIGS. 19-20) that provide structural support to the wall panel 112. The ledge 12 may support the weight of the ash catch 118, the grate 116, and the fuel. The ledge 124 that is created is used to support a flange 140 that extends around the periphery of the ash catch 118 to support the same thereon during use. When all the wall panels 112 are coupled together, the ledges 124 cooperate to define an inner passageway 136 through which a lower portion of the ash catch passes.

Figure 5:
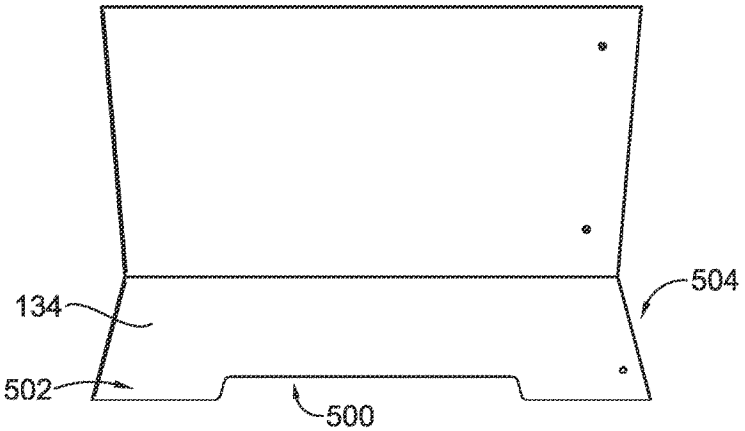
FIG. 5 is a right side elevation view of the fire pit of FIG. 1.

FIG. 5 is a right side elevation view of the fire pit 110 of FIG. 1. In the illustrated embodiment, all four wall panels 112 are of identical construction for ease of manufacture and assembly. As such, each of the side views would be identical for this version. Other embodiments may exist and are within the scope of the present disclosure. For example, two opposite wall panels 112 may be wider than two other wall panels 112 to create a rectangular dual wall assemblable fire pit 110 of the present disclosure. Various combinations and sizes of wall panels 112 may be used to create assemblable fire pits 110 of various sizes, shapes, and dimensions.

Also shown in FIG. 5 is the base 134. In some embodiments, the base 134 includes a cutout or recess 500 which defines two legs 502. The recess 500 allows for unevenness in the underlying surface to not affect the stability of the base 134. The two legs include a flared segment 504 that extends laterally. The flared segment 504 increases the lateral stability of the base 134.

FIG. 6 illustrates an exploded view of the fire pit 110 of FIG. 1. The topmost component is the grate 116 with the structural cross arms depicted thereon. Immediately below that, is the removable ash catch 118. The ash catch 118, much like the inner walls 120, includes a plurality of airflow openings 138 around the upper portion thereof that allow air to come up from underneath the fire pit 110 during use and through the ash catch 118 to helped fuel the combustion of the material placed in the burn chamber 114. A flange (or flanges) 140 extends horizontally outward from each of the sidewalls of the ash catch 118 and is designed to rest on the ledge 124 created by the lower end 128 of the inner sidewalls 120. Below the ash catch 118 are each of the four identical (in the illustrated embodiment) wall panels 112.

While illustrated in FIG. 6 as four identical wall panels 112 in other embodiments they could be four (or more or less) distinct wall panels. Specifically, embodiments of the invention may include a first wall panel 610, a second wall panel 612, a third wall panel 614, and a fourth wall panel 616. As discussed herein, in embodiments, the first wall panel 610 is identical to the second wall panel 612, the third wall panel 614, and the fourth wall panel 616. In other embodiments, the first wall panel 610 may be identical to the third wall panel 614, while the second wall panel 612 is identical to the fourth wall panel 616 (with the first and third wall panels 112 610, 614 having a different length than the second and fourth wall panels 112 616).

Figure 7:
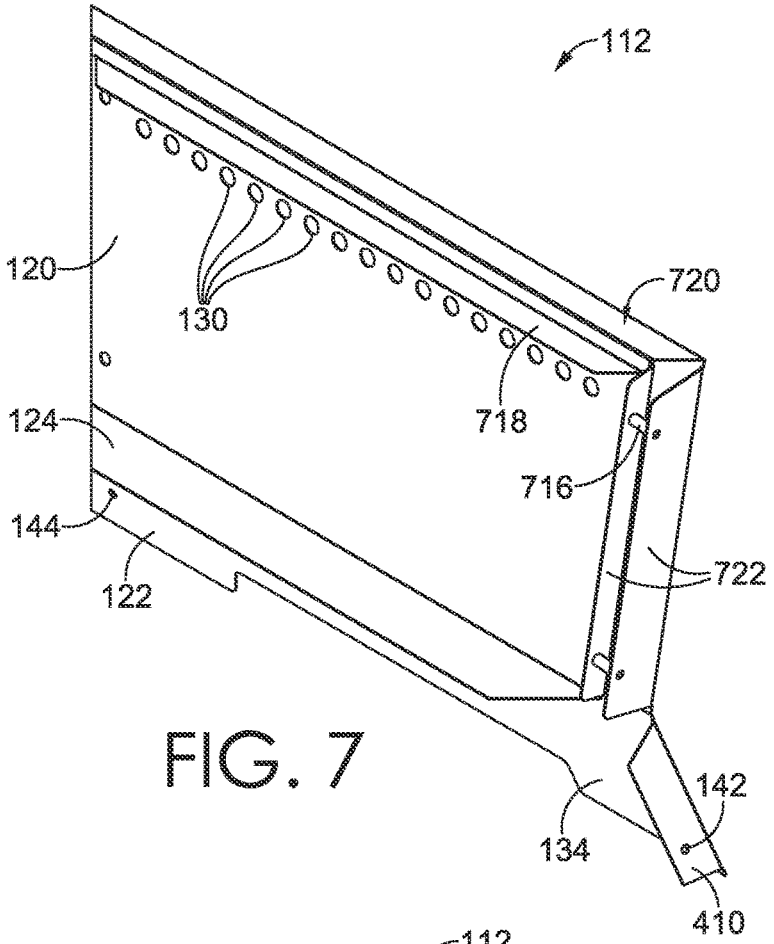
FIG. 7 is a top right perspective view of one of the side walls of the fire pit of FIG. 1 from a third angle.
Figure 8:
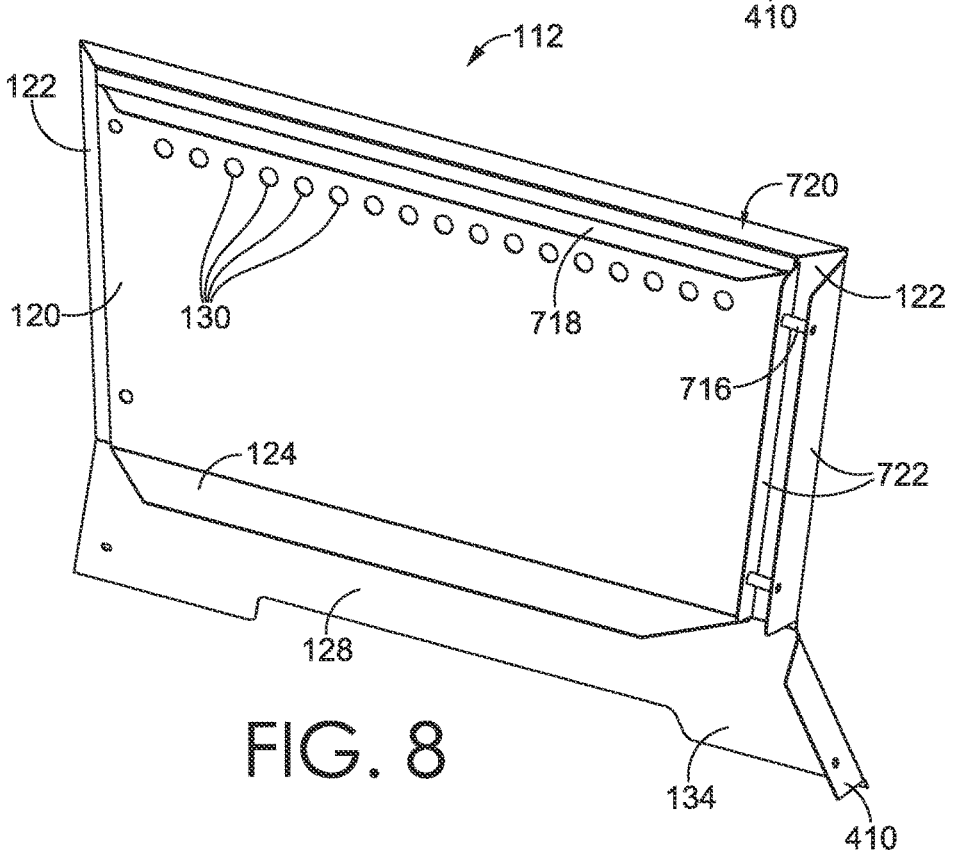
FIG. 8 is a top right perspective view of the side wall of FIG. 7 from a fourth angle.
Figure 22:
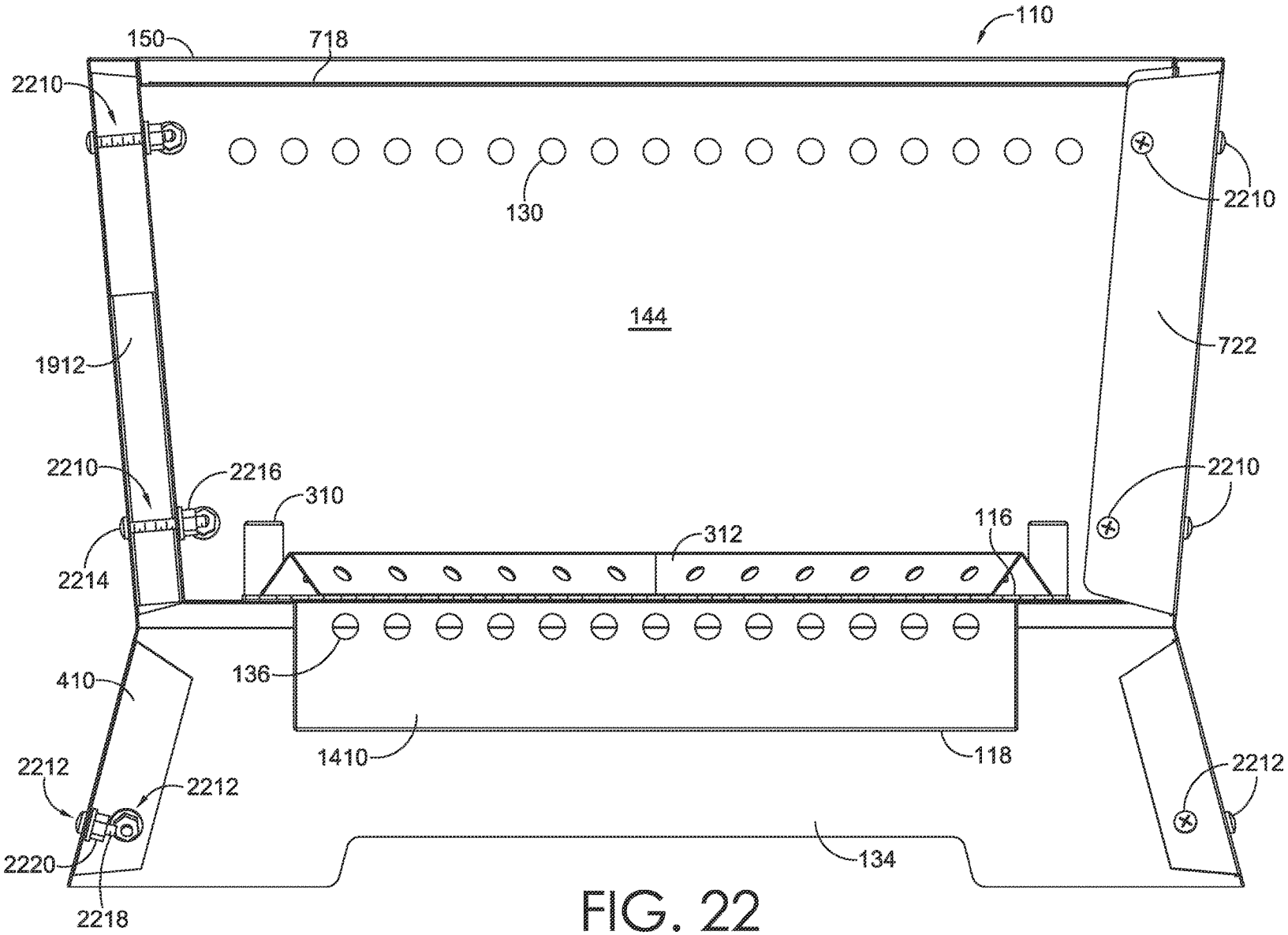
FIG. 22 is a front perspective view of the fire pit of FIG. 1 with the front side wall removed, in accordance with some embodiments of the present disclosure.
Figure 24:
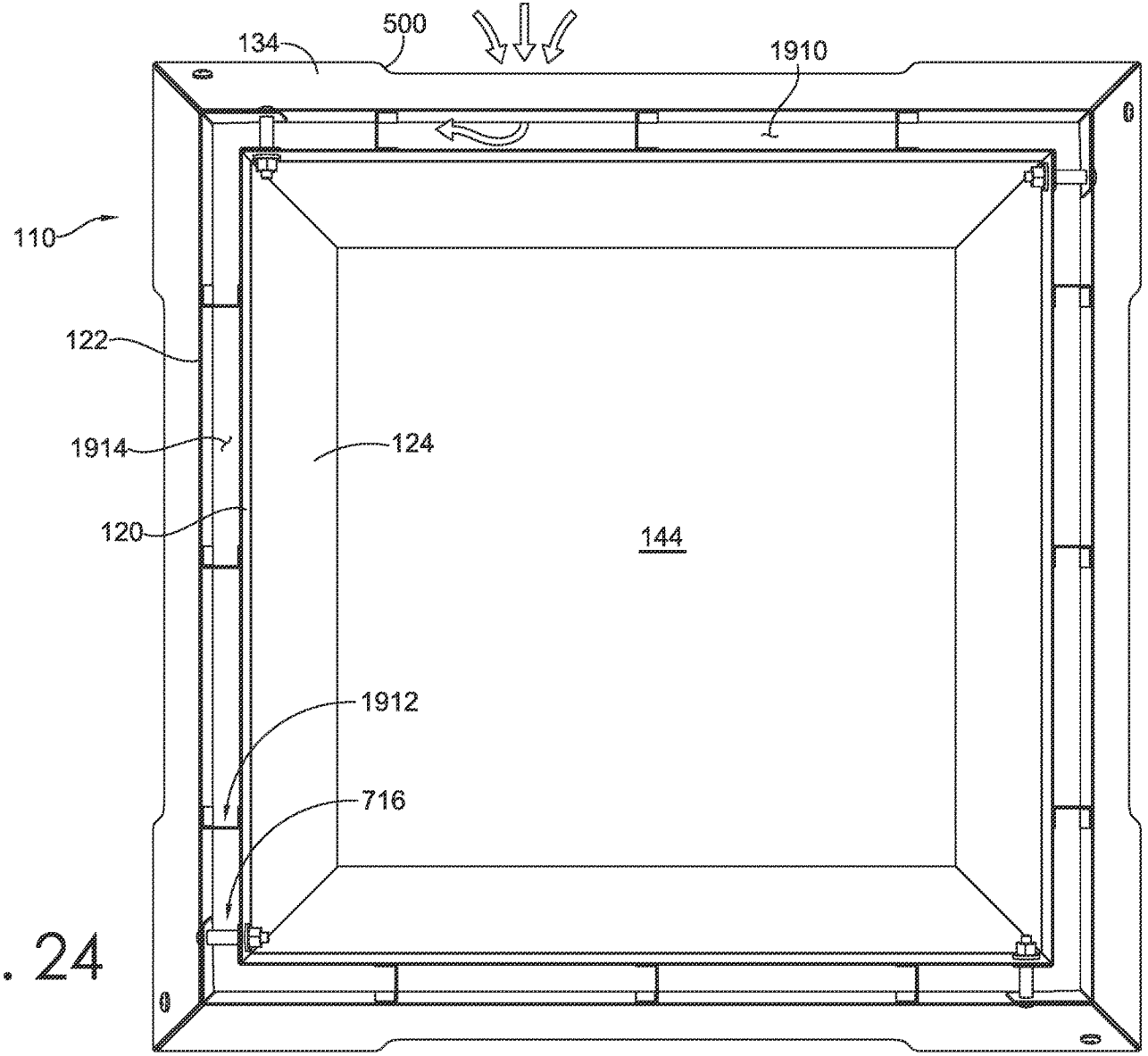
FIG. 24 is a top plan view of a horizontal cross-section of the fire pit of FIG. 1, showing how air flows through the wall panels.

FIGS. 7 and 8 both illustrate perspective views of the wall panel 112 from an upper location looking down towards the inner wall 120 of the wall panel 112 opposite the outer wall 122. The flange 124 extends inward from the inner wall 120. Other flanges may include an upper flange 718, an outer flange 720, and a pair of vertical assembly flanges 722. On the right-hand side of both wall panels 112, spacer tubes 716 are provided between the vertical assembly flanges 722 and separate the inner vertical assembly flange 722 of the inner wall 120 from the outer vertical assembly flange 722 of the outer wall 122. The vertical assembly flanges 722 extends at an approximate right angle inwardly from both the outer wall 122 and the inner wall 120. The assembly flanges 722 are designed to be received in the space between the inner and outer wall 120, 122 of an adjacent wall panel during assembly. In the illustrated embodiment, the spacer tubes 716 have been positioned between the inner and outer wall assembly flanges to assist with the assembly process. The tubes 716 connect upper holes of the flanges and connect the lower holes of the flanges. This arrangement helps guide a bolt through the double-walled wall panel 112 during assembly so that the bolt does not get out of alignment inside the double wall construction. The bolt is shown in FIGS. 22 and 24. The tubes 716 may be omitted and assembly still performed in the same manner.

Also visible in FIGS. 7 and 8 is the securing tab or flange 410 which extends inwardly from the lower end 128 of the exterior wall segment 122 that forms the base 134. The securing tab 410 is also used to assemble or couple one wall panel 112 to an adjacent wall panel 112. The securing tab 410 has a hole 142 therethrough for assembly and, on an opposite edge of the lower end 128 of the base of the exterior wall segment 122, a corresponding hole 144 is provided. The hole 142 of one panel 112 is aligned with the hole 144 of an adjacent panel 112 during assembly. As can be seen, a portion of the lower end 128 along the bottom edge of the exterior wall segment 122 is cut out define feet portions of the base 134 of the wall panel 112, as well as to permit and assist with the flow of air from outside the fire pit 110 up underneath the fire pit 110 during use.

Figure 9:
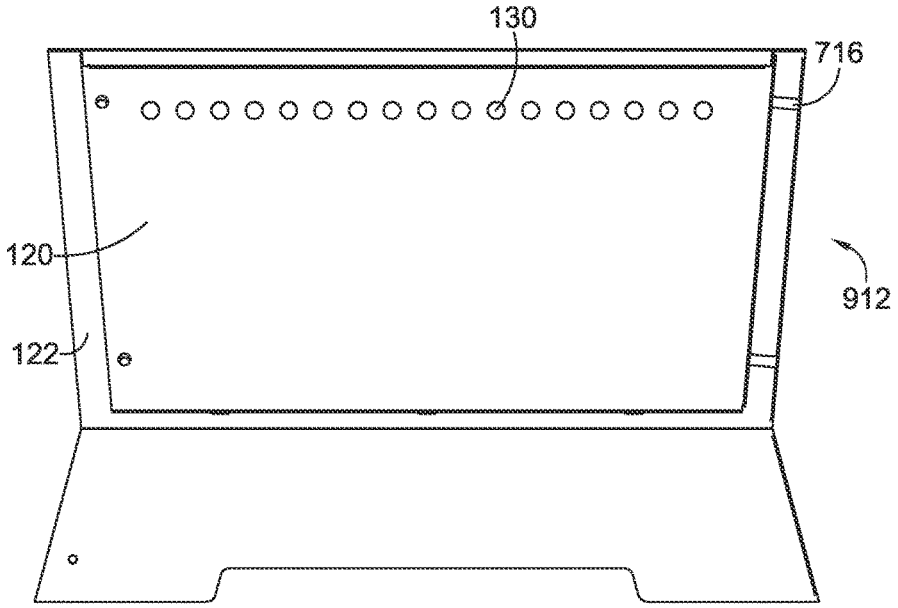
FIG. 9 is a front elevation view of an interior of the side wall of FIG. 7.
Figure 12:
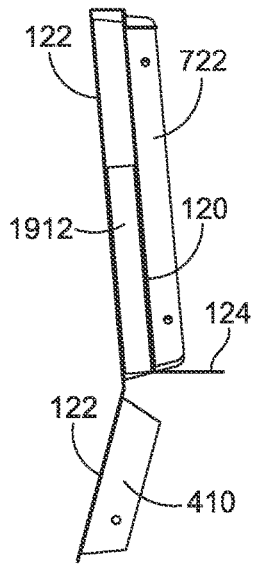
FIG. 12 is a left side elevation view of the side wall of FIG. 7.
Figure 10:
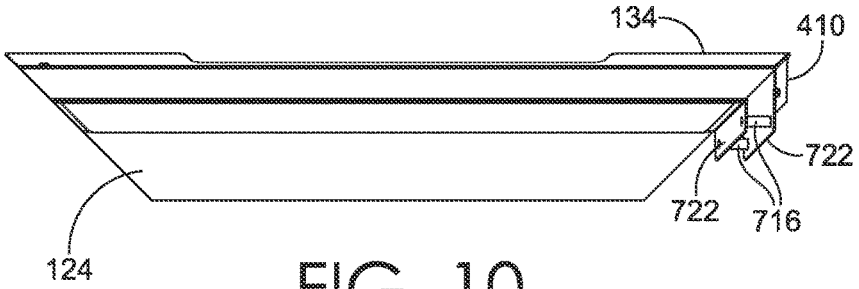
FIG. 10 is a top plan view of the side wall of FIG. 7.
Figure 11:
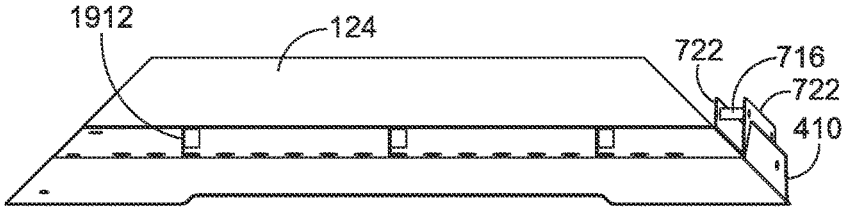
FIG. 11 is a bottom plan view of the side wall of FIG. 7.
Figure 13:
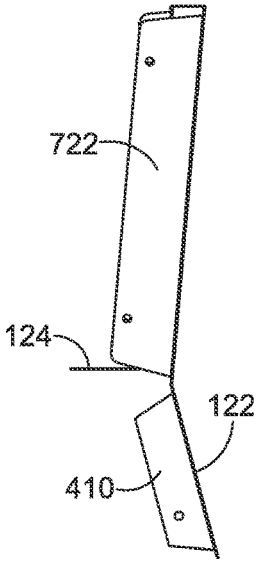
FIG. 13 is a right side elevation of the side wall of FIG. 7.
Figure 19:
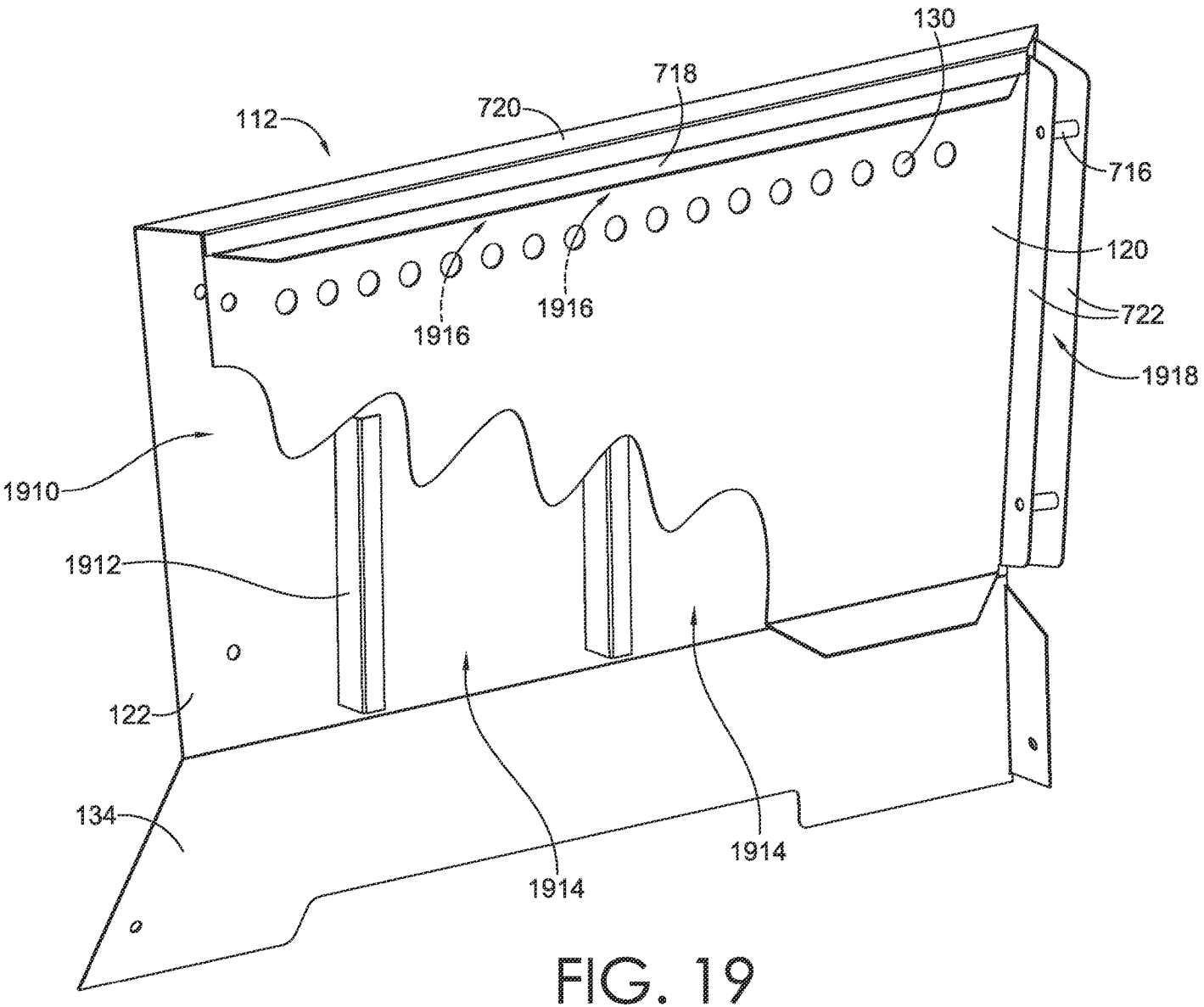
FIG. 19 is a top left perspective view of the side wall of FIG. 7 from a fifth angle with a portion of an interior wall cutaway to illustrate gussets found in the side wall in the illustrated embodiment.

FIG. 9 is a side elevation view of one of the wall panels 112 from an interior vantage point. FIG. 10 is a top plan view of the wall panel 112 of FIG. 9 and FIG. 11 is a bottom plan view of the wall panel 112 of FIG. 9. FIG. 12 is a left side elevation view of the wall panel 112 of FIG. 9 and FIG. 13 is a right side elevation view of the wall panel 112 of FIG. 9. Visible in FIGS. 11 and 12, and more clearly shown in FIG. 19, are gussets 1912 that are positioned between the interior wall panel 120 and the exterior wall panel 122 of the wall panel 112 to provide increase structural integrity so that the wall panels 112 do not flex toward and away from each other during use. The gussets 1912 also provide increased strength for the wall panels 112. When positioned in the vertical orientation, as best illustrated in FIG. 19, the gussets 1912 permit air to still flow up through the space between the interior wall 120 and exterior wall 122 of the wall panel 112 and out the upper portion of the interior wall 120 through the plurality of airflow openings 130, such that heated air flows back into the burn chamber 114, further fueling the combustion of the material therein.

FIG. 10 shows the spacer tubes 716 that span between the outer vertical assembly flange 722 and the inner vertical assembly flange 722. In addition to providing guidance to the bolts during assembly, the tubes 716 provide additional structural rigidity between the inner and outer flanges 722 and increase the overall rigidity and longevity of the fire pit 110.

Figure 14:
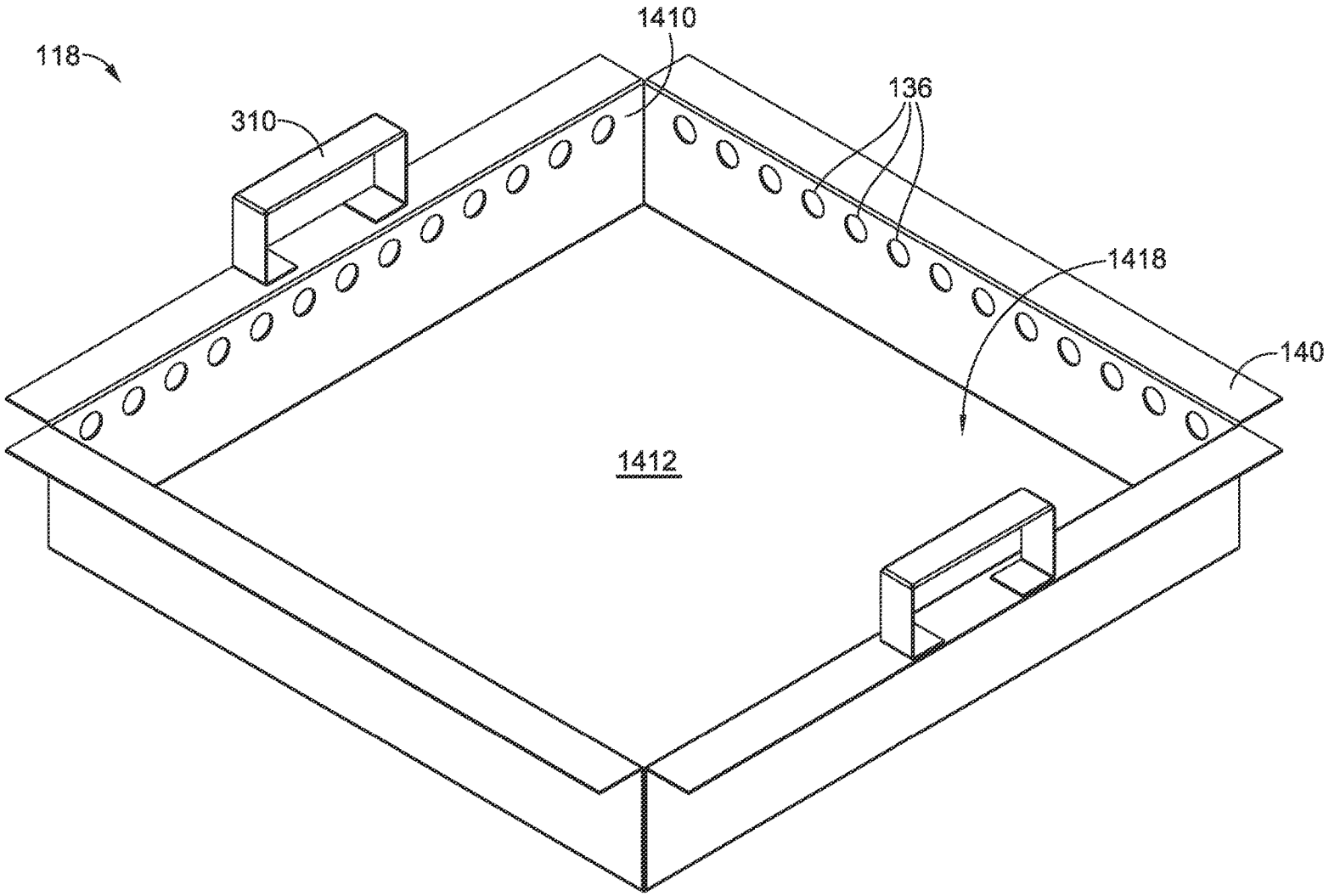
FIG. 14 is a top perspective view of the ash catch of the fire pit of FIG. 1.

FIG. 14 illustrates a top perspective view of the burn pan or ash catch 118. In embodiments, the ash catch 118 includes a set of sidewalls 1410 rising from a base 1412. The support flanges 140 extend outward from one or more of the sidewalls 1410 and are configured to rest on top of the flange 124 of the fire pit 110. The handles 310 permit the user to lift the ash catch 118 out of the burn chamber 114 through the upper end 126 of the burn chamber 114 and may be coupled with two of the support flanges 140, as shown in FIG. 14. The plurality of airflow openings 136 allow air to flow into an ash chamber 1418 of the ash catch 118. The airflow into the ash chamber 1418 helps feed the fire above the ash chamber 1418 (specifically, atop the grate 116.

FIG. 15 is a top plan view of the ash catch 118. As can be seen, in embodiments the ash catch 118 is generally square shaped. In other embodiments, the ash catch 118 may be another shape. FIG. 16 is a front elevation view of the ash catch 118 and FIG. 17 is a right side elevation view the ash catch 118. As can be seen, the handle of the ash catch 118 may rise from the support flange 140. As shown in FIG. 17, the handle may include a traversing member 1710 configured to be grasped by the user. The traversing member 1710 spans between two extending members 1712 that rise from the support flange 140. The traversing members 1712 are each secured to the support flange via a base member 1714. The traversing member 1710, extending members 1714, and support flange 1414 present a general rectangular shape, as best shown in FIG. 17, configured to receive a hand of the user for removal of the ash catch 118.

Figure 18:
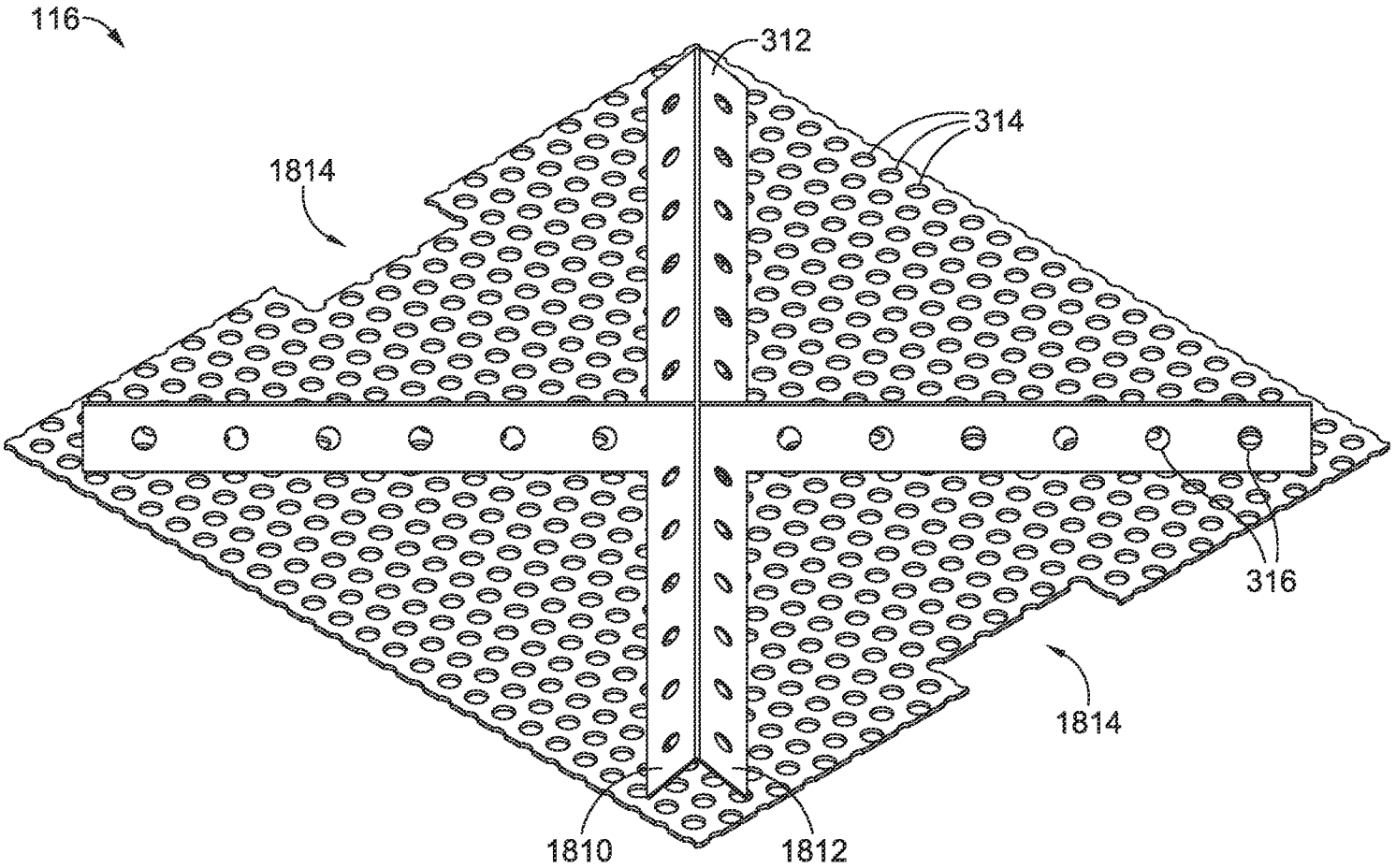
FIG. 18 is a top perspective view of the grate of FIG. 1.

FIG. 18 is a perspective view of the grate 116 with the structural support cross arms 312 thereon. It should be appreciated that some embodiments may not include the structural support cross arms 312, or they may be included on an underside of the grate 116. The structural support cross arms 312 provide increased rigidity to a thin metal grate 116. The structural support cross arms 312 thus assist in supporting a heavy fuel (e.g., logs) being placed inside the fire pit 110 to be burned. The structural support cross arms 312 may be formed of a left arm segment 1810 and a right arm segment 1812. The left and right arm segments 1810, 1812 may be disposed at a ninety-degree angle relative to each other, and each disposed at a forty-five degree angle relative to the grate 116. The left and right arm segments 1810, 1812 may each include one or more openings 316 to allow ash and air to pass there through. Also shown in FIG. 18 are a pair of recesses 1814 that allows the handle 310 of the ash catch 118 to pass. As such, when the user removes the ash catch 118, the grate 116 will also be removed as the grate 116 rests at least in part on the support flange 140 of the ash catch 118, as shown in FIG. 22.

FIG. 19 is a perspective view of one of the wall panels 112 of the illustrated embodiment with a portion of the interior wall segment 120 cut away to reveal an airflow chamber 1910 formed between the inner wall 120 and the exterior wall 122. Positioned in the airflow chamber 1910 are the plurality of gussets 1912. In the illustrated embodiment, the gussets 1912 do not run all the way from the top of the base 134 up to the upper end 126 of the wall panel 112 but instead only run a portion of the way up the interior of the wall panel 112. This permits air to move around inside the wall panel 112. However, in another embodiment, the gussets 1912 may go all the way to the top or may be omitted completely. The airflow chamber 1910 may include vertical air passageways 1914 that lead between the gussets 1912 and to air input passageways 1916 through the airflow openings 130. The airflow chamber thus allows air to flow up through the wall panel 112 and into the burn chamber 114 to feed the fire therein.

It should be appreciated that while two gussets 1912 are illustrated in FIG. 19, more or fewer gussets may be used in embodiments of the invention. In the illustrated embodiment, a third gusset (visible in FIGS. 4, 11, and 24) is disposed under a right side of the wall panel 112. The three gussets provided in the dual wall chamber between the exterior wall segment 122 and interior wall segment 120 of the wall panel 112 provide structural rigidity thereto.

Figure 21:
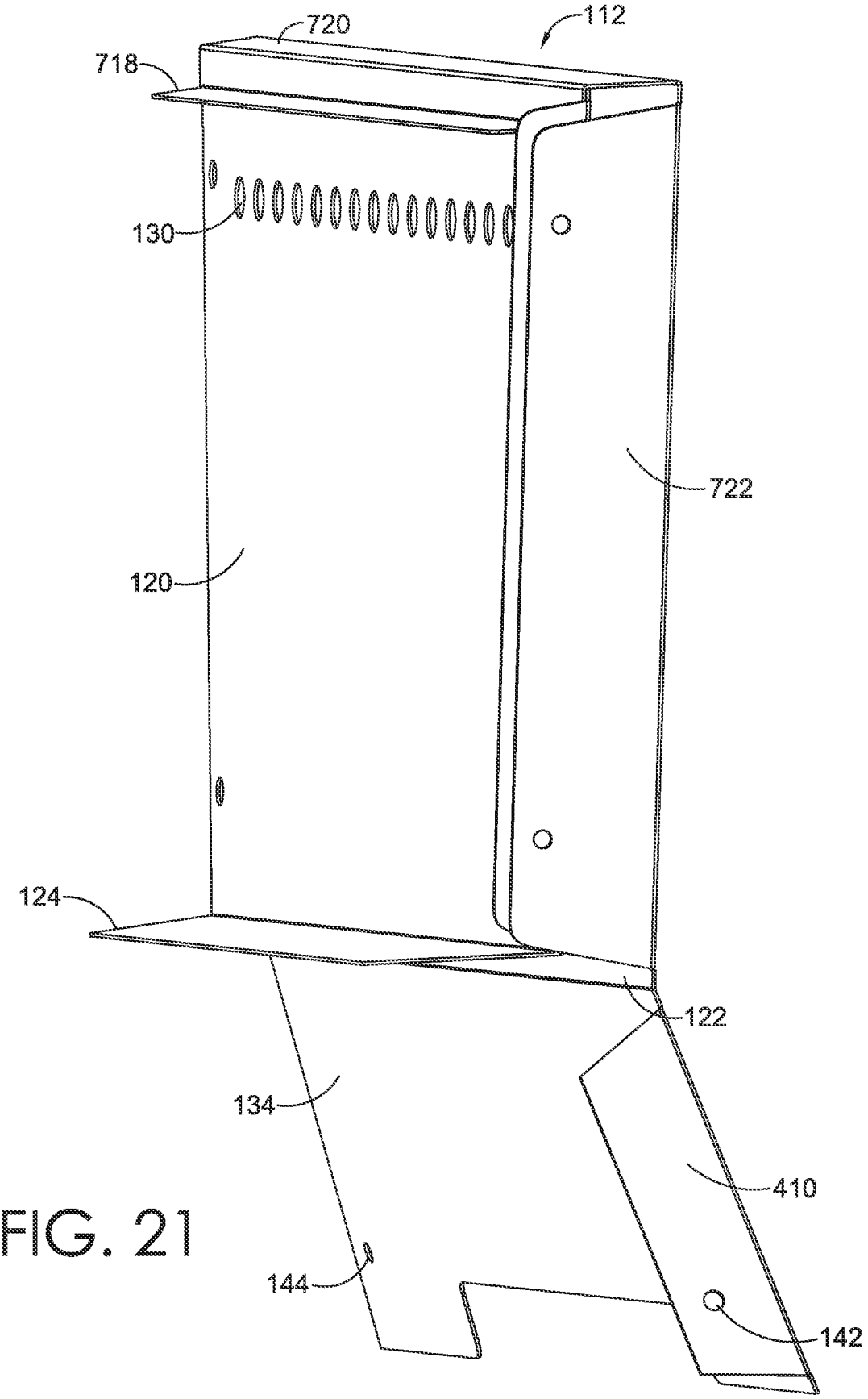
FIG. 21 is a top right perspective view of the side wall of FIG. 7 from a seventh angle showing two respective flanges.

FIGS. 20 and 21 are perspective views similar to the elevation view of FIGS. 12 and 13. While a wall panel 112 may be formed from the bending of a single sheet of sheet metal, in the illustrated embodiment, the interior wall segment 120 is formed from a first sheet 2010 (e.g., formed of sheet metal) and the exterior wall segment 122 is formed from a second sheet 2012 (e.g., formed of sheet metal). Regarding the second sheet 2012, the exterior wall segment 122 includes the lower end 128 bent outwardly that forms the base 134, transitions at a bend 146 to define the exterior wall segment 122, transitions at an upper edge 148 with an approximate right angle to form the flat upper surface or outer flange 720 of the wall panel 112, and is then bent downwardly at bend 150, which defines a thickness of the wall panel 112. The metal is then bent again at a generally right angle at bend 152 to form the upper flange 718 which sticks inwardly towards the burn chamber 114. The upper flange 718 directs the flow of heated air out of the airflow openings 130 at the upper end 126 of the interior wall segment 120 back into the burn chamber 114 to help create the double burn. The upper flange 718 may also be used to support a grill to be placed above the burn chamber 114 to permit the user to use the fire pit 110 to cook food.

Regarding the first sheet 2010, the upper end 126 of the interior wall segment 120 is coupled to the portion of the second sheet 2012 that extends downwardly from the upper surface 720 before turning to the inward flange 718 (i.e., the vertical portion between bends 150 and 152). The lower end 128 of the interior wall segment 120 is turned inwardly to define the support flange 124 for the ash catch 118.

FIG. 22 is a front side elevation view of the fire pit 110 of FIG. 1, but with the front side panel 112 removed for clarity to show inside the assembled fire pit 110 and the burn chamber 114. Wall-assembly bolts 2210 are disposed through a wall panel 112 and into an adjacent wall panel 112. Base-assembly bolts 2212 are disposed through the base into the securing tab 410 of an adjacent wall panel 112. The wall assembly bolts 2210 that are used to assemble the removed front side panel to the left side panel are still visible, but the tubes 716 that they pass through were removed when the front wall panel 112 was omitted, for clarity. The wall-assembly bolts 2210 may include a bolt body 2214 and a nut 2216. The base-assembly bolts 2212 may include a bolt body 2218 and a nut 2220. The bolt bodies 2214, 2218 are slid through the respective openings and the nuts 2216, 2220 are rotationally placed onto a distal end of the bolt body 2214, 2218 so as to secure the nuts 2216, 2220 to the bolt bodies 2214, 2218. In this way, the fire pit 110 110 may be easily assembled by the end user, to allow for the fire pit 110 110 to be shipped in a disassembled form.

Figure 23:
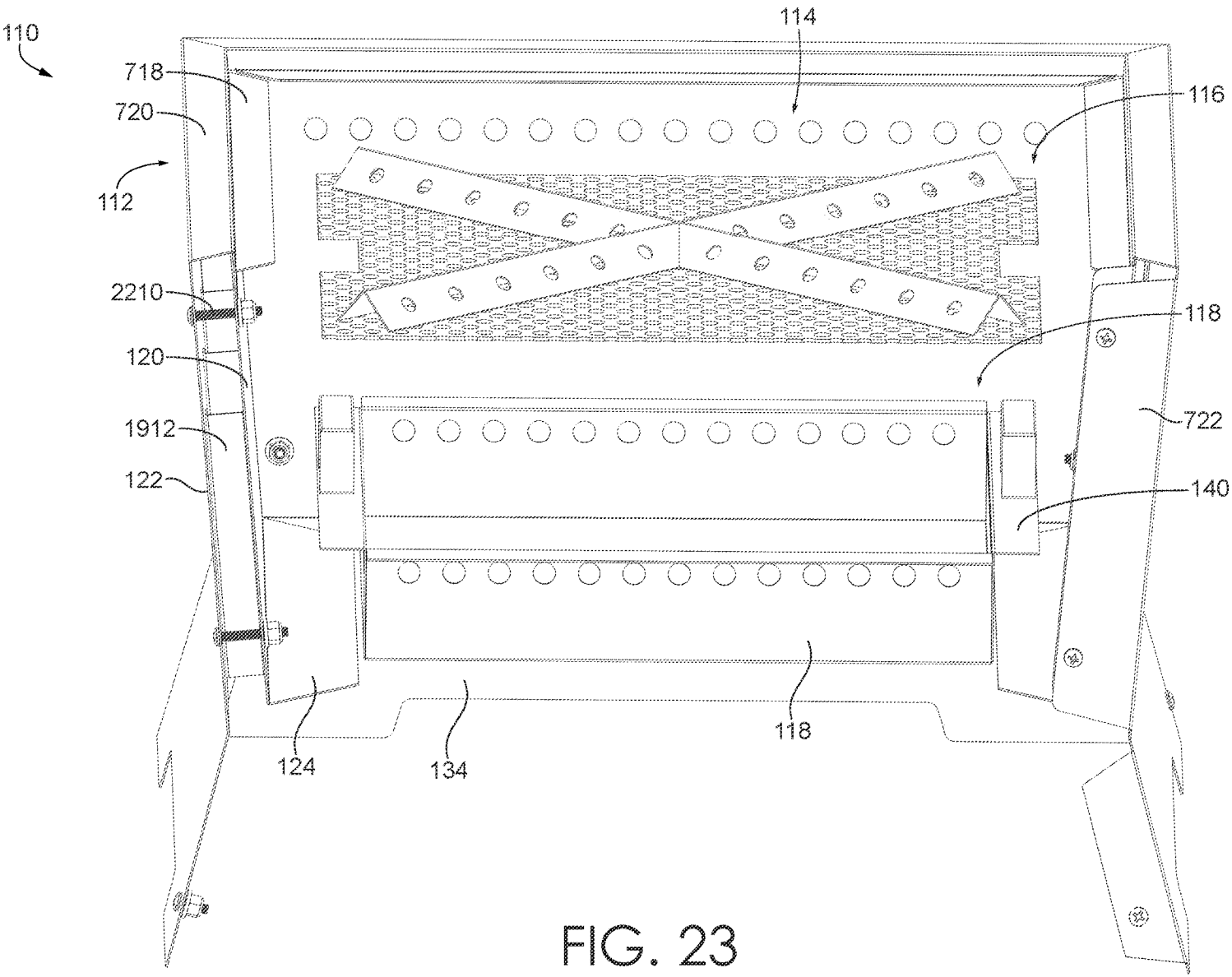
FIG. 23 is a front-top top view of the fire pit of FIG. 22, having the grate and the ash catch raised in a partial exploded view fashion to show how components fit together.

FIG. 23 is the same fire pit 110 of FIG. 22 but from a downward angle. Further, the ash catch 118 has been partly lifted up as if being removed from the fire pit 110 from the top opening thereof to dispose of ash or contents contained therein. Further, the grate 116 that sits on top of the ash catch 118 during use has also been lifted up even higher to provide greater visibility of the construction of the interior of the firebox and the manner in which the grate 116 sits on the ash catch 118 and the ash catch 118 sits on the ledge 124 formed by the flanges of the lower end 128 of the interior wall segment 120 of each wall panel 112.

FIG. 24 is a top plan view of the illustrated fire pit 110 in cross-section to permit the viewing of the area between the interior wall segment 120 and the exterior wall segment 122 of each wall panel 112, with the grate 116 and ash catch 118 removed. This view illustrates that the bottom of each wall panel 112 is open to permit air to flow up underneath the fire pit 110 and up through the air chambers 1910 defined by the dual wall construction. The spacing is assured through the gussets 1912 and the tubes 716. Air may flow under the fire pit 110 from outside of the fire pit 110 by going under the cutout portion 500 in the base 134 section of the wall panels 112 and then may flow through the airflow openings 136 around the upper periphery of the sidewalls 1410 of the ash catch 118 into the burn chamber 114 itself. Air may also flow up under the base 134 and then up through the dual wall construction 112. As it flows up through the dual wall passage, it is heated. As it is heated, it begins to rise faster and is then redirected through the airflow openings 130 back into the burn chamber 114 to further fuel combustion of the material therein.

Accordingly, the illustrated embodiment provides an assemblable dual wall fire pit 110. The fire pit 110 may be shipped flat and unassembled to reduce its size. It may then be readily assembled by a user by connecting the four wall panels 112 together. Additional wall panels 112 may be used to create fire pits 110 of other shapes such as a pentagon, a triangle, an octagon, etc. The ash catch 118 may be readily removable by lifting up through the top of the assembled fire pit 110, thereby making for easy removal of the ash without disassembly of the fire pit 110. The ash catch 118 may be of any shape or size to correspond with the opening of the fire pit 110. The ash catch 118 may also be used with or without the grate 116 thereon. Combustible material may be placed directly in the ash catch 118, if so desired. The grate 116, however holds the combustible material up off the bottom of the ash catch 118 to provide for greater circulation of air there around during combustion, thereby resulting in improved combustion.

In embodiments, the construction of the individual wall panels 112 also provides for a uni-body design by having both the base portion integrally formed with the sidewalls to define both the legs, the sidewalls, and upper and lower support areas all in a single wall panel. The construction also provides for a simple but sturdy tongue and groove (or mortise and tenon) type connection between adjacent wall panels 112 with the assembly flanges of each wall panel acting as a tongue and the space between the interior wall segment 120 and the exterior wall segment 122 defining the groove into which the tongue of an adjacent wall panel 112 is received for assembly.

In embodiments of the invention, an end user may assemble the fire pit 110. The user may secure a first wall panel 112 and a second wall panel 112. The user may align the first wall panel 112 with the second wall panel 112, such that one or more bolts may be placed through a component of the first wall panel 112 and a component of the second wall panel 112. The bolt may then be secured with a nut to hold the first wall panel 112 securely to the second wall panel 112. The user may then continue so as to secure the second wall panel 112 to a third wall panel 112, the third wall panel 112 to a fourth wall panel 112, and the fourth wall panel 112 to the first wall panel 112. Once all of the wall panels 112 are assembled, the user may insert the ash catch 118 and the grate 116 into the burn chamber 114. Further, the user may insert a fuel, such as wood pellets, into the burn chamber 114. The user may then apply a fire starter to the fuel in order to start a fire. A fire starter may include an electric fire starter, a chemical fire starter (not recommended), a fire source (such as a lit match or a lit lighter), or the like. As heated air rises through the wall panels 112, it flows into the burn chamber 114 at a top end. The heated air coming into the burn chamber 114 may prompt a secondary flame or secondary burning of the fuel.

Embodiments of the invention are directed to a fire pit system configured to be assembled by an end user. The system includes a plurality of wall panels, an ash catch, and a grate. The plurality of wall panels is configured to secured by the end user to form a burn chamber. Each of the plurality of wall panels has an interior wall segment spaced apart from an exterior wall segment. Each interior wall segment includes at least one opening in an upper end to allow airflow into the burn chamber. The ash catch is removably positionable and configured to be disposed within the burn chamber by the end user. The grate is positionable above the ash catch by the end user.

The opening is configured to allow airflow from a lower end into the burn chamber. Each wall panel of the plurality of wall panels may include a gusset disposed between the interior wall segment and the exterior wall segment configured to allow for vertical airflow through the wall panel. The fire pit system may also include a tube disposed between the interior wall segment and the exterior wall segment configured to receive a bolt there through. The bolt at least partially secures the one wall panel to another wall panel. Each wall panel of the plurality of wall panels may be formed from a first sheet and a second sheet, with the first sheet forming the outer wall segment of the wall panel with an upper portion bent back and a lower portion bent out to form a base, and the second sheet forming the inner wall segment with a lower portion bent inwardly to form a flange. The ash catch includes a peripheral flange, and wherein the peripheral flange of the ash catch rests on the flange of the wall panels when the fire pit is assembled. The grate is configured to rest on the peripheral flange of the ash catch, and includes a recess to allow a handle of the ash catch to pass around the grate.

In embodiments, a method of assembling a fire pit may include securing a plurality of wall panels to form a burn chamber, wherein each of the plurality of wall panels has an interior wall segment spaced apart from an exterior wall segment, positioning an ash catch on a flange of the interior wall segment within the burn chamber; and positioning a grate above the ash catch, wherein a first wall panel of the plurality of wall panels is configured to be connected together by aligning the hole in one flange with the hole on the opposite edge of an adjacent panel. The method may further include orienting the inner wall toward the burn chamber such that an opening at an upper end of the inner wall is configured to allow airflow from a lower end into the burn chamber. The method may further include orienting the inner wall such that a gusset disposed between the interior wall segment and the exterior wall segment is oriented vertically, so as to allow for vertical airflow through the wall panel.

The above-discussed step of securing may include inserting a bolt into a tube disposed between the interior wall segment and the exterior wall segment, wherein the bolt at least partially secures the first wall panel to the second wall panel.

The method may further include placing the base onto an underling surface, wherein each wall panel of the plurality of wall panels is formed from a first sheet and a second sheet, the first sheet forming the outer wall segment of the wall panel with an upper portion bent back and a lower portion bent out to form the base. The above-discussed step of positioning the ash catch may include placing a peripheral flange of the ash catch onto the flange of the wall panels when the fire pit is assembled.

Embodiments of the invention are directed to a method of burning fuel in a fire pit. The method may include placing an ash catch into the fire pit and placing a grate atop the ash catch. The method may include placing a fuel into a burn chamber of the fire pit atop the grate and the ash catch. The method may further include applying a fire starter to the fuel so as to create a fire in the burn chamber. Following usage, the method may include removing the ash catch from the burn chamber and disposing of the ashes within the ash catch. The method may further include removing the ash catch from the burn chamber by lifting it up through the burn chamber and out a top of the burn chamber. The method may further include removing the grate along with the unburnt fuel if any.

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. For example, while the illustrated embodiment discloses a desirable embodiment of a ready-to-assemble ("RTA") fire pit, several disclosed features may be omitted and a still desirable RTA fire pit would be provided and within the scope of the present invention. For example, in the illustrated embodiment the RTA fire pit includes a removable ash catch that is supported by the side walls and a grate that is supported on the ash catch. One or both of the ash catch and the grate could be omitted and a still desirable RTA fire pit could be provided. The ash catch could be omitted (letting the ash simply fall to the ground) or designed to support itself on the ground when positioned freestanding inside the space defined by the assembled walls. Similarly, the grate could be omitted (with the fuel placed in the ash catch or on the ground) or designed to be supported directly by the side walls spaced apart from and above the ash catch.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

The subject matter of the present disclosure is described with specificity herein to meet statutory requirements. However, the description itself is not intended to limit the scope of this disclosure. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

What is claimed is:

1. A fire pit having a burn chamber, the fire pit comprising:

a wall panel defining a lateral boundary of the burn chamber, the wall panel having an interior wall segment spaced apart from and exterior wall segment to define a passageway there between, a lower opening to allow air to flow through the lower opening up into the passageway, a plurality of openings in an upper portion of the interior wall segment to allow air to flow from the passageway out into the burn chamber, and a ledge extending inwardly from the interior wall segment; and an ash catch removably positionable in the burn chamber to define a lower boundary of the burn chamber, wherein an upper periphery of the wall panel defines a lateral boundary of an upwardly facing opening in the fire pit, wherein fuel or combustible material is received into the burn pit through the upwardly facing opening, wherein the ash catch is receivable in the burn chamber through the upwardly facing opening, wherein the ash catch includes a flange, and wherein the flange is supported on the ledge when the ash catch is placed in the burn chamber;

a grate removably positionable in the burn chamber for supporting fuel or combustible material thereon, the grate positioned above the ash catch and having holes therein such that ash created in the burn chamber by burning fuel or combustible material falls through the grate and into an ash chamber of the ash catch, wherein the ash catch has handles that extend upwardly into the burn pit, wherein the grate rests on top of the ash catch, and wherein a user may remove both the ash catch and the grate from the fire pit by lifting upwardly on the handles to raise both the ash catch and the grate up through the burn chamber and out the upwardly facing opening.

2. The fire pit of claim 1, wherein the wall panel is formed from a first sheet and a second sheet, the first sheet forming the outer wall segment of the wall panel with an upper portion bent back and a lower portion bent out to form a base.

3. The fire pit of claim 1, wherein the ash catch includes a base with one or more sidewalls extending upwardly therefrom, wherein at least one of the one or more sidewalls includes a plurality of airflow openings to allow air to flow from outside the ash catch, through the plurality of airflow openings, and into the ash chamber, and wherein the air from the ash chamber may flow upwardly from the ash chamber into the bottom of the burn chamber to help feed a fire in the burn chamber.

* * * * *